US010091600B2

(12) United States Patent
Chon et al.

(10) Patent No.: US 10,091,600 B2
(45) Date of Patent: Oct. 2, 2018

(54) STEREOPHONIC SOUND REPRODUCTION METHOD AND APPARATUS

(71) Applicant: SAMSUNG ELECTRONICS CO., LTD., Suwon-si (KR)

(72) Inventors: Sang-bae Chon, Suwon-si (KR); Sun-min Kim, Suwon-si (KR); Hyun Jo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/029,143

(22) PCT Filed: Oct. 27, 2014

(86) PCT No.: PCT/KR2014/010134

§ 371 (c)(1),
(2) Date: Apr. 13, 2016

(87) PCT Pub. No.: WO2015/060696

PCT Pub. Date: Apr. 30, 2015

(65) Prior Publication Data

US 2016/0269845 A1 Sep. 15, 2016

(30) Foreign Application Priority Data

Oct. 25, 2013 (KR) ..... 10-2013-0128038

(51) Int. Cl.
*H04S 3/00* (2006.01)
*H04S 7/00* (2006.01)

(52) U.S. Cl.
CPC ..... *H04S 3/008* (2013.01); *H04S 3/002* (2013.01); *H04S 7/30* (2013.01); *H04S 2400/03* (2013.01); *H04S 2420/01* (2013.01); *H04S 2420/07* (2013.01)

(58) Field of Classification Search
None
See application file for complete search history.

(56) References Cited

U.S. PATENT DOCUMENTS 8,170,246 B2 5/2012 Yoo et al.
8,675,899 B2 3/2014 Jung
9,107,018 B2 8/2015 Lamb et al.
(Continued)

FOREIGN PATENT DOCUMENTS

CN 1630434 A 6/2005
CN 102246543 A 11/2011
(Continued)

OTHER PUBLICATIONS

Samsung, "HT-F9750W", Product's description at http://www.samsung.com/uk/consumer/tv-audio-video/audio-video/home-theatre-systems/HT-F9750W/XU, printed May 2, 2016, total 6 pages.
(Continued)

*Primary Examiner* — Curtiz Kuntz
*Assistant Examiner* — Kenny Truong
(74) *Attorney, Agent, or Firm* — Sughrue Mion, PLLC

(57) ABSTRACT

A three-dimensional sound reproducing method includes: acquiring a multichannel audio signal; rendering signals to a channel to be reproduced according to channel information and a frequency of the multichannel audio signal; and mixing the rendered signals.

21 Claims, 10 Drawing Sheets

(56) References Cited

U.S. PATENT DOCUMENTS

| | | | | |
|---|---|---|---|---|
| 9,282,417 | B2 | 3/2016 | Harma et al. | |
| 9,361,896 | B2 | 6/2016 | Disch et al. | |
| 2004/0247134 | A1* | 12/2004 | Miller, III | H04S 3/002 381/19 |
| 2005/0135643 | A1 | 6/2005 | Lee et al. | |
| 2007/0081597 | A1 | 4/2007 | Disch et al. | |
| 2007/0269062 | A1 | 11/2007 | Rodigast et al. | |
| 2011/0261967 | A1 | 10/2011 | Walther et al. | |
| 2012/0008789 | A1 | 1/2012 | Kim et al. | |
| 2012/0314875 | A1 | 12/2012 | Lee et al. | |
| 2013/0173273 | A1* | 7/2013 | Kuntz | G10L 19/008 704/500 |
| 2013/0259236 | A1 | 10/2013 | Chon et al. | |
| 2014/0219456 | A1* | 8/2014 | Morrell | H04S 5/00 381/17 |
| 2015/0146873 | A1* | 5/2015 | Chabanne | H04S 3/008 381/1 |
| 2016/0044434 | A1 | 2/2016 | Chon et al. | |

FOREIGN PATENT DOCUMENTS

| | | | |
|---|---|---|---|
| CN | 102726066 | A | 10/2012 |
| CN | 103053180 | A | 4/2013 |
| CN | 103081512 | A | 5/2013 |
| CN | 103369453 | A | 10/2013 |
| EP | 2154911 | A1 | 2/2010 |
| EP | 2645749 | A2 | 10/2013 |
| JP | 2001-16698 | A | 1/2001 |
| JP | 2009-511966 | A | 3/2009 |
| JP | 2013-533703 | A | 8/2013 |
| KR | 10-2008-0071805 | A | 8/2008 |
| KR | 10-2009-0054802 | A | 6/2009 |
| KR | 10-2010-0114450 | A | 10/2010 |
| KR | 10-2012-0004909 | A | 1/2012 |
| KR | 10-2012-0137253 | A | 12/2012 |
| WO | 2010/066271 | A1 | 6/2010 |
| WO | 2012/145176 | A1 | 10/2012 |
| WO | 2014/157975 | A1 | 10/2014 |

OTHER PUBLICATIONS

ISO/IEC FDIS 23003-3:2011(E), "Information technology—MPEG audio technology—Part 3: Unified Speech and Audio Coding", Jul. 22, 2011, total 293 pages.

ISO/IEC 23003-1:2007(E), "Information technology—MPEG audio technologies—Part 1: MPEG Surround", Feb. 15, 2007, total 288 pages.

Christian Uhle, "Applause Sound Detection", Journal of Audio Engineering Society, vol. 59, No. 4, Apr. 2011, pp. 213-224.

Ville Pulkki, "Virtual Sound Source Positioning Using Vector Base Amplitude Panning", Journal of Audio Engineering Society, vol. 45, No. 6, Jun. 1997, pp. 456-466.

International Search Report dated Jan. 16, 2015, issued by the International Searching Authority in International Application No. PCT/KR2014/010134 [PCT/ISA/210].

Written Opinion dated Jan. 16, 2015, issued by the International Searching Authority in International Application No. PCT/KR2014/010134 [PCT/ISA/237].

Communication dated Nov. 23, 2016, issued by the State Intellectual Property Office of P.R. China in counterpart Chinese Application No. 201480058551.1.

Gerard Hotho et al., "Multichannel Coding of Applause Signals", EURASIP Journal on Advances in Signal Processing, Jan. 1, 2008, vol. 2008, Article ID 531693, Hindawi Publishing Corporation, 9 pages total. XP055132552.

Communication dated Feb. 28, 2017 by the Japanese Patent Office in counterpart Japanese Patent Application No. 2016-523302.

Communication dated Mar. 10, 2017 by the European Patent Office in counterpart European Patent Application No. 14855641.8.

Communication dated Aug. 22, 2017, issued by the State Intellectual Property Office of P.R. China in counterpart Chinese Application No. 201480058551.1.

Communication issued by the Japanese Patent Office dated Jan. 16, 2018 in counterpart Japanese Patent Application No. 2016-523302.

* cited by examiner

STEREOPHONIC SOUND REPRODUCTION METHOD AND APPARATUS

CROSS-REFERENCE TO RELATED APPLICATION

This is a National Stage Entry of International Application No. PCT/KR2014/010134 filed Oct. 27, 2014, claiming priority based on Korean Patent Application No. 10-2013-0128038 filed Oct. 25, 2013, the contents of all of which are incorporated herein by reference in their entirety.

TECHNICAL FIELD

One or more exemplary embodiments relate to a three-dimensional (3D) sound reproducing method and apparatus, and more particularly, to a multichannel audio signal reproducing apparatus and method.

BACKGROUND ART

With the advance in video and audio processing technologies, the production of high-definition, high-quality content has increased. Users, who in the past have demanded high-definition, high-quality content, desire realistic images and sound, and thus, extensive research has been conducted to provide 3D images and 3D sound.

A 3D sound technology enables a user to sense space by arranging a plurality of speakers at different positions on a horizontal plane and outputting the same sound signal or different sound signals through the speakers. However, an actual sound may be generated from different positions on a horizontal plane and may also be generated at different elevations. Therefore, there is a need for a technology that reproduces sound signals generated at different elevations through speakers arranged on a horizontal plane.

DETAILED DESCRIPTION OF THE INVENTION

Technical Solution

One or more exemplary embodiments include a 3D sound reproducing method and apparatus capable of reproducing a multichannel audio signal, including an elevation sound signal, in a horizontal plane layout environment.

Advantageous Effects

According to the one or more of the above exemplary embodiments, the 3D sound reproducing apparatus may reproduce the elevation component of the sound signal through speakers arranged on the horizontal plane, so that a user is able to sense elevation.

According to the one or more of the above exemplary embodiments, when the multichannel audio signal is reproduced in an environment in which the number of channels is small, the 3D sound reproducing apparatus may prevent a tone from changing or prevent a sound from disappearing.

DESCRIPTION OF THE DRAWINGS

These and/or other aspects will become apparent and more readily appreciated from the following description of the exemplary embodiments, taken in conjunction with the accompanying drawings in which.

BEST MODE

Figure 1:
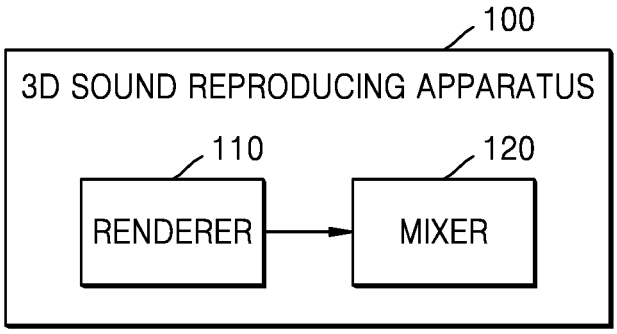
FIGS. 1 and 2 are block diagrams of 3D sound reproducing apparatuses according to exemplary embodiment.

Additional aspects will be set forth in part in the description which follows and, in part, will be apparent from the description, or may be learned by practice of the presented exemplary embodiments.

According to one or more exemplary embodiments, a three-dimensional sound reproducing method includes: acquiring a multichannel audio signal; rendering signals to a channel to be reproduced according to channel information and a frequency of the multichannel audio signal; and mixing the rendered signals.

The three-dimensional sound reproducing method may further include separating an applause signal from the multichannel audio signal, wherein the rendering includes rendering the applause signal according to a two-dimensional rendering method or rendering the applause signal to a closest channel among output channels arranged on a horizontal plane with respect to each channel of the applause signal.

The mixing may include mixing the rendered applause signal according to an energy boost method.

The separating of the applause signal from the multichannel audio signal may include: determining whether the applause signal is included in the multichannel audio signal, based on at least one selected from among whether non-tonal wideband signals are present in the multichannel audio signal and levels of the wideband signals are similar with respect to each channel, whether an impulse of a short section is repeated, and whether inter-channel correlation is low; and separating the applause signal according to a determination result.

The rendering may include: separating the multichannel audio signal into a horizontal channel signal and an overhead channel signal, based on the channel information; separating the overhead channel signal into a low-frequency signal and a high-frequency signal; rendering the low-frequency signal to a closest channel among output channels arranged on a horizontal plane with respect to each channel of the low-frequency signal; rendering the high-frequency signal according to a three-dimensional rendering method; and rendering the horizontal channel signal according to a two-dimensional rendering method.

The mixing may include: determining a gain to be applied to the rendered signals according to the channel information and the frequency; and applying the determined gain to the rendered signals and mixing the rendered signals.

The mixing may include mixing the rendered signals, based on power values of the rendered signals, such that the power values of the rendered signals are preserved.

The mixing may include: mixing the rendered signals with respect to each predetermined section, based on the power values of the rendered signals; separating low-frequency signals among the rendered signals; and mixing the low-frequency signals based on the power values of the rendered signals in a previous section.

According to one or more exemplary embodiments, a three-dimensional reproducing apparatus includes: a renderer that acquires a multichannel audio signal and renders signals to a channel to be reproduced according to channel information and a frequency of the multichannel audio signal; and a mixer that mixes the rendered signals.

The three-dimensional sound reproducing apparatus may further include a sound analysis unit that separates an applause signal from the multichannel audio signal, wherein the renderer renders the applause signal according to a two-dimensional rendering method or renders the applause signal to a closest channel among output channels arranged on a horizontal plane with respect to each channel of the applause signal.

The mixer may mix the rendered applause signal according to an energy boost method.

The sound analysis unit may determine whether the applause signal is included in the multichannel audio signal, based on at least one selected from among whether non-tonal wideband signals are present in the multichannel audio signal and levels of the wideband signals are similar with respect to each channel, whether an impulse of a short section is repeated, and whether inter-channel correlation is low.

The renderer may separate the multichannel audio signal into a horizontal channel signal and an overhead channel signal based on the channel information, separate the overhead channel signal into a low-frequency signal and a high-frequency signal, renders the low-frequency signal to a closest channel among output channels arranged on a horizontal plane with respect to each channel of the low-frequency signal, render the high-frequency signal according to a three-dimensional rendering method, and render the horizontal channel signal according to a two-dimensional rendering method.

The mixer may determine a gain to be applied to the rendered signals according to the channel information and the frequency, apply the determined gain to the rendered signals, and mix the rendered signals.

The mixer may mix the rendered signals, based on power values of the rendered signals, such that the power values of the rendered signals are preserved.

Mode of the Invention

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description.

As the terms used herein, so far as possible, the most widely used terms are selected in consideration of functions in the exemplary embodiments; however, these terms may vary according to the intentions of those skilled in the art, the precedents, or the appearance of new technology. Some terms used herein may be arbitrarily chosen by the present applicant. In this case, these terms will be defined in detail below. Accordingly, the specific terms used herein should be understood based on the unique meanings thereof and the whole context of the inventive concept.

It will also be understood that the terms "comprises", "includes", and "has", when used herein, specify the presence of stated elements, but do not preclude the presence or addition of other elements, unless otherwise defined. Also, the terms "unit" and "module" used herein represent a unit for processing at least one function or operation, which may be implemented by hardware, software, or a combination of hardware and software.

Exemplary embodiments will be described below in detail with reference to the accompanying drawings so that those of ordinary skill in the art may easily implement the inventive concept. The inventive concept may, however, be embodied in many different forms and should not be construed as being limited to the exemplary embodiments set forth herein. In addition, portions irrelevant to the description of the exemplary embodiments will be omitted in the drawings for a clear description of the exemplary embodiments, and like reference numerals will denote like elements throughout the specification.

Figure 2:
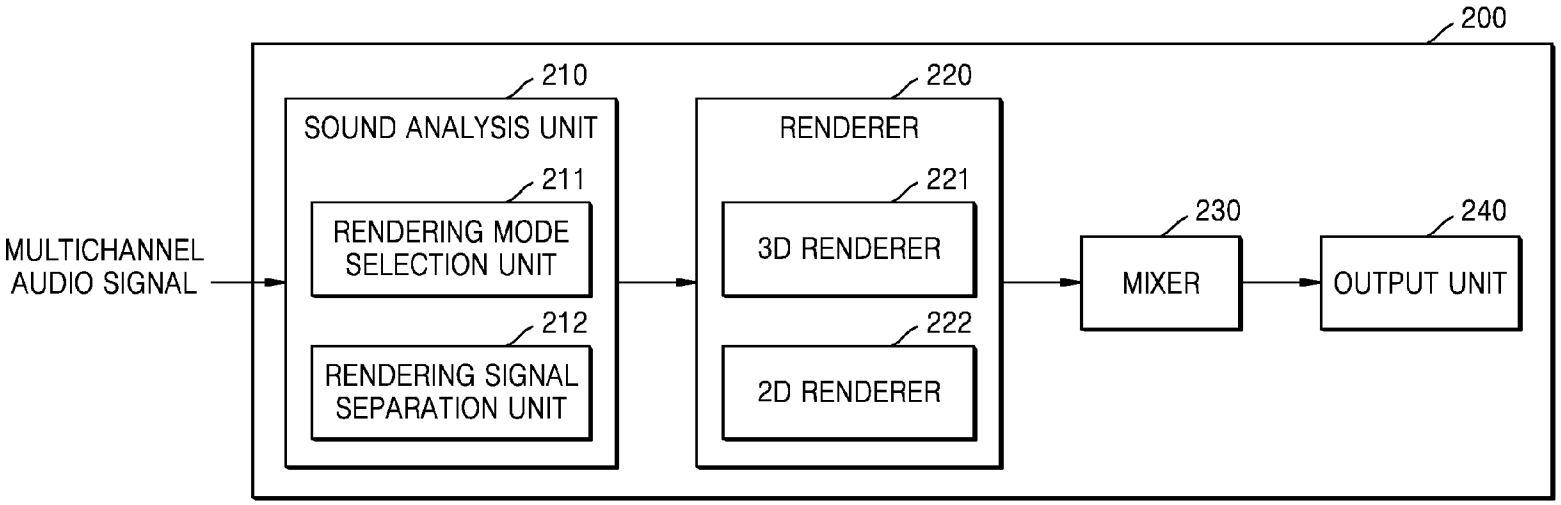

FIGS. 1 and 2 are block diagrams of 3D sound reproducing apparatuses 100 and 200 according to exemplary embodiments.

The 3D sound reproducing apparatus 100 according to an exemplary embodiment may output a downmixed multichannel audio signal through a channel to be reproduced.

A 3D sound refers to a sound that enables a listener to sense the ambience by reproducing a sense of direction or distance as well as a pitch and a tone and has space information that enables a listener, who is not located in a space where a sound source is generated, to sense direction, sense distance, and sense space.

In the following description, a channel of an audio signal may be the number of speakers through which a sound is output. As the number of channels increases, the number of speakers may increase. The 3D sound reproducing apparatus 100 according to the exemplary embodiment may render a multichannel audio signal to channels to be reproduced and mix rendered signals, such that a multichannel audio signal having a large number of channels is output and reproduced in an environment in which the number of channels is small. At this time, the multichannel audio signal may include a channel capable of outputting an elevation sound.

The channel capable of outputting the elevation sound may be a channel capable of outputting a sound signal through a speaker located over the head of a listener so as to enable the listener to sense elevation. A horizontal channel may be a channel capable of outputting a sound signal through a speaker located on a plane parallel to a listener.

The environment in which the number of channels is small may be an environment that does not include a channel capable of outputting an elevation sound and can output a sound through speakers arranged on a horizontal plane according to a horizontal channel.

In addition, in the following description, the horizontal channel may be a channel including an audio signal that can be output through a speaker arranged on a horizontal plane. An overhead channel may be a channel including an audio signal that can be output through a speaker that is arranged at an elevation but not on a horizontal plane and is capable of outputting an elevation sound.

Referring to FIG. 1, the 3D sound reproducing apparatus 100 according to the exemplary embodiment may include a renderer 110 and a mixer 120.

The 3D sound reproducing apparatus 100 according to the exemplary embodiment may render and mix a multichannel audio signal and output the rendered multichannel audio signal through a channel to be reproduced. For example, the multichannel audio signal is a 22.2 channel signal, and the channel to be reproduced may be a 5.1 or 7.1 channel. The 3D sound reproducing apparatus 100 may perform rendering by determining channels corresponding to the respective channels of the multichannel audio signal, combine signals of the respective channels corresponding to the channel to be reproduced, mix rendered audio signals, and output a final signal.

The renderer 110 may render the multichannel audio signal according to a channel and a frequency. The renderer 110 may perform 3D rendering and 2D rendering on an overhead channel signal and a horizontal channel signal of the multichannel audio signal.

The renderer 110 may render the overhead channel passing through a head related transfer filter (HRTF) by using different methods according to frequency, so as to 3D-render the overhead channel. The HRTF filter may enable a listener to recognize a 3D sound by a phenomenon that characteristics on a complicated path are changed according to a sound arrival direction. The characteristics on the complicated path include diffraction from a head surface and reflection from auricles as well as a simple path difference such as a level difference between both ears and an arrival time difference of a sound signal between both ears. The HRTF filter may process audio signals included in the overhead channel by changing sound quality of the audio signals, so as to enable a listener to recognize a 3D sound.

The renderer 110 may render low-frequency signals among the overhead channel signals by using an add-to-the-closest-channel panning method, and may render high-frequency signals by using a multichannel panning method. According to the multichannel panning method, at least one horizontal channel may be rendered by applying gain values that are differently set to channel signals of a multichannel audio signal when the channel signals are rendered. The channel signals, to which the gain values are applied, may be mixed and output as a final signal.

The low-frequency signal has a strong diffractive characteristic. Accordingly, similar sound quality may be provided to a listener even when rendering is performed on only one channel, instead of performing rendering after dividing channels of the multichannel audio signal to a plurality of channels according to the multichannel panning method. Therefore, the 3D sound reproducing apparatus 100 according to the exemplary embodiment may render the low-frequency signal by using the add-to-the-closest-channel panning method, thus preventing sound quality from being degraded when a plurality of channels are mixed to one output channel. That is, if a plurality of channels are mixed to one output channel, sound quality may be amplified or decreased according to interference between the channel signals, resulting in a degradation in sound quality. Therefore, the degradation in sound quality may be prevented by mixing one channel to one output channel.

According to the add-to-the-closest-channel panning method, channels of the multichannel audio signal may be rendered to the closest channel among channels to be reproduced, instead of being rendered to a plurality of channels.

In addition, by performing rendering in different methods according to frequency, the 3D sound reproducing apparatus 100 may widen a sweet spot without degrading sound quality. That is, by rendering a low-frequency signal having a strong diffractive characteristic according to the add-to-the-closest-channel panning method, it is possible to prevent sound quality from being degraded when a plurality of channels are mixed to one output channel. The sweet spot may be a predetermined range that enables a listener to optimally listen to a 3D sound without distortion. As a sweet spot is wider, a listener may optimally listen to a 3D sound without distortion. When a listener is not located at a sweet spot, the listener may listen to a sound with distorted sound quality or sound image.

Rendering using different panning methods according to frequency will be described in detail with reference to FIG. 4 or 5.

The mixer 120 may output a final signal by combining signals of the channels corresponding to the horizontal channel by the renderer 110. The mixer 120 may mix the signals of the channels with respect to each predetermined section. For example, the mixer 120 may mix the signals of the channels with respect to each frame.

The mixer 120 according to the exemplary embodiment may mix the signals based on power values of signals rendered to channels to be reproduced. In other words, the mixer 120 may determine an amplitude of the final signal or a gain to be applied to the final signal, based on power values of signals rendered to channels to be reproduced.

Referring to FIG. 2, the 3D sound reproducing apparatus 200 according to an exemplary embodiment may include a sound analysis unit 210, a renderer 220, a mixer 230, and an output unit 240. The 3D sound reproducing apparatus 200, the renderer 220, and the mixer 230 in FIG. 2 correspond to the 3D sound reproducing apparatus 100, the renderer 110, and the mixer 120 in FIG. 1, and thus, redundant descriptions thereof are omitted.

The sound analysis unit 210 may select a rendering mode by analyzing a multichannel audio signal and separate some signals from the multichannel audio signal. The sound analysis unit 210 may include a rendering mode selection unit 211 and a rendering signal separation unit 212.

The rendering mode selection unit 211 may determine whether many transient signals are present in the multichannel audio signal, with respect to each predetermined section. Examples of the transient signals may include a sound of applause, a sound of rain, and the like. In the following description, an audio signal, which includes many transient signals such as the sound of applause or the sound of rain, will be referred to as an applause signal.

The 3D sound reproducing apparatus 200 according to the exemplary embodiment may separate the applause signal and perform channel rendering and mixing according to the characteristic of the applause signal.

The rendering mode selection unit 211 may select one of a general mode and an applause mode according to whether the applause signal is included in the multichannel audio signal. The renderer 220 may perform rendering according to the mode selected by the rendering mode selection unit 211. That is, the renderer 220 may render the applause signal according to the selected mode.

The rendering mode selection unit 211 may select the general mode when no applause signal is included in the multichannel audio signal. In the general mode, the overhead channel signal may be rendered by a 3D renderer 221 and the horizontal channel signal may be rendered by a 2D renderer 222. That is, rendering may be performed without taking into account the applause signal.

The rendering mode selection unit 211 may select the applause mode when the applause signal is included in the multichannel audio signal. In the applause mode, the applause signal may be separated and rendering may be performed on the separated applause signal.

The rendering mode selection unit 211 may determine whether the applause signal is included in the multichannel audio signal, with respect to each predetermined section, by using applause bit information that is included in the multichannel audio signal or is separately received from another device. According to an MPEG-based codec, the applause bit information may include bsTsEnable or bsTempShapeEnableChannel flag information, and the rendering mode selection unit 211 may select the rendering mode according to the above-described flag information.

In addition, the rendering mode selection unit 211 may select the rendering mode based on the characteristic of the multichannel audio signal in a predetermined section to be determined. That is, the rendering mode selection unit 211 may select the rendering mode according to whether the characteristic of the multichannel audio signal in the predetermined section has the characteristic of the audio signal including the applause signal.

The rendering mode selection unit 211 may determine whether the applause signal is included in the multichannel audio signal, based on at least one condition among whether wideband signals that are not tonal to a plurality of input channels are present in the multichannel audio signal and levels of the wideband signals are similar with respect to each channel, whether an impulse of a short section is repeated, and whether inter-channel correlation is low.

The rendering mode selection unit 211 may select the applause mode when it is determined that the applause signal is included in the multichannel audio signal in the current section.

When the rendering mode selection unit 211 selects the applause mode, the rendering signal separation unit 212 may separate the applause signal included in the multichannel audio signal from a general sound signal.

When a bsTsdEnable flag based on MPEG USAC is used, 2D rendering may be performed according to the flag information, regardless of elevation of the corresponding channel, as in the horizontal channel signal. In addition, the overhead signal may be assumed to be the horizontal channel signal and be mixed according to the flag information. That is, the rendering signal separation unit 212 may separate the applause signal from the multichannel audio signal of the predetermined section according to the flag information, and may 2D-render the separated applause signal as in the horizontal channel signal.

In a case where no flag is used, the rendering signal separation unit 212 may analyze a signal between the channels and separate an applause signal component. The applause signal separated from the overhead signal may be 2D-rendered, and the signals other than the applause signal may be 3D-rendered.

The renderer 220 may include the 3D renderer 221 that renders the overhead signal according to a 3D rendering method, and the 2D renderer 222 that renders the horizontal channel signal or the applause signal according to the 2D rendering method.

The 3D renderer 221 may render the overhead signal in different methods according to frequency. The 3D renderer 221 may render a low-frequency signal by using an add-to-the-closest-channel panning method and may render a high-frequency signal by using the 3D rendering method. Hereinafter, the 3D rendering method may be a method of rendering the overhead signal and may include a multichannel panning method.

The 2D renderer 222 may perform rendering by using at least one selected from a method of 2D-rendering a horizontal channel signal or an applause signal, an add-to-the-closest-channel panning method, and an energy boost method. Hereinafter, the 2D rendering method may be the method of rendering the horizontal channel signal and may include a downmix equation or a vector base amplitude panning (VBAP) method.

The 3D renderer 221 and the 2D renderer 222 may be simplified by matrix transform. The 3D renderer 221 may perform downmixing through a 3D downmix matrix defined by a function of an input channel, an output channel, and a frequency. The 2D renderer 222 may perform downmixing through a 2D downmix matrix defined by a function of an input channel, an output channel, and a frequency. That is, the 3D or 2D downmix matrix may downmix an input multichannel audio signal by including coefficients capable of being determined according to the input channel, the output channel, or the frequency.

When rendering is performed, an amplitude part of the sound signal for each frequency is more important than a phase part of the sound signal. Therefore, the 3D renderer 221 and the 2D renderer 222 may perform rendering by using the downmix matrix including the coefficients capable of being determined according to each frequency value, thus reducing the amount of computations of rendering. Signals, which are rendered through the downmix matrix, may be mixed according to a power preserving module of the mixer 230 and be output as a final signal.

The mixer 230 may calculate the rendered signals with respect to each channel and output the final signal. The mixer 230 according to the exemplary embodiment may mix the rendered signals based on power values of signals included in the respective channels. Therefore, the 3D sound reproducing apparatus 200 according to the exemplary embodiment may reduce tone distortion by mixing the rendered signals based on the power values of the rendered signals. The tone distortion may be caused by frequency reinforcement or offset.

The output unit 240 may finally output the output signal of the mixer 230 through the speaker. At this time, the output unit 240 may output the sound signal through different speakers according to the channel of the mixed signal.

Figure 3:
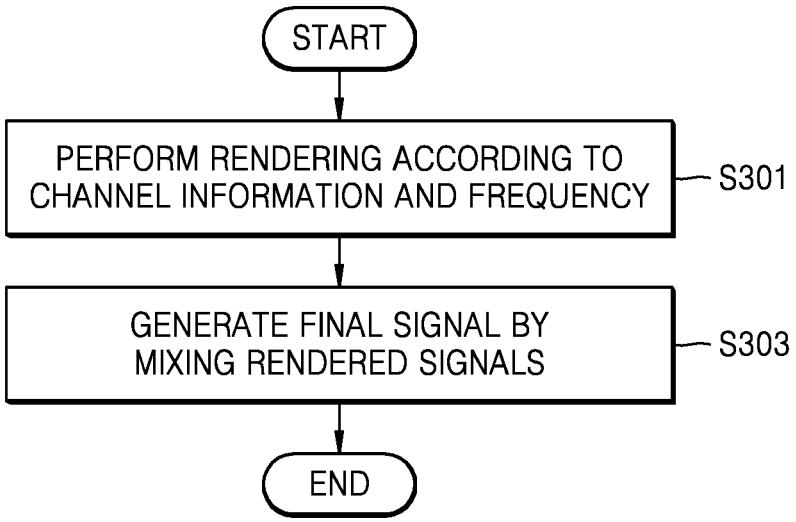
FIG. 3 is a flowchart of a 3D sound reproducing method according to an exemplary embodiment.

FIG. 3 is a flowchart of a 3D sound reproducing method according to an exemplary embodiment.

Referring to FIG. 3, in operation S301, the 3D sound reproducing apparatus 100 may render a multichannel audio signal according to channel information and a frequency. The 3D sound reproducing apparatus 100 may perform 3D rendering or 2D rendering according to the channel information and may render a low-frequency signal, taking into consideration the feature of the low-frequency signal.

In operation S303, the 3D sound reproducing apparatus 100 may generate a final signal by mixing the signals rendered in operation S301. The 3D sound reproducing apparatus 100 may perform rendering by determining channels to output signals of the respective channels of the multichannel audio signal, perform mixing by adding or performing an arithmetic operation on the rendered signals, and generate the final signal.

Figure 4:
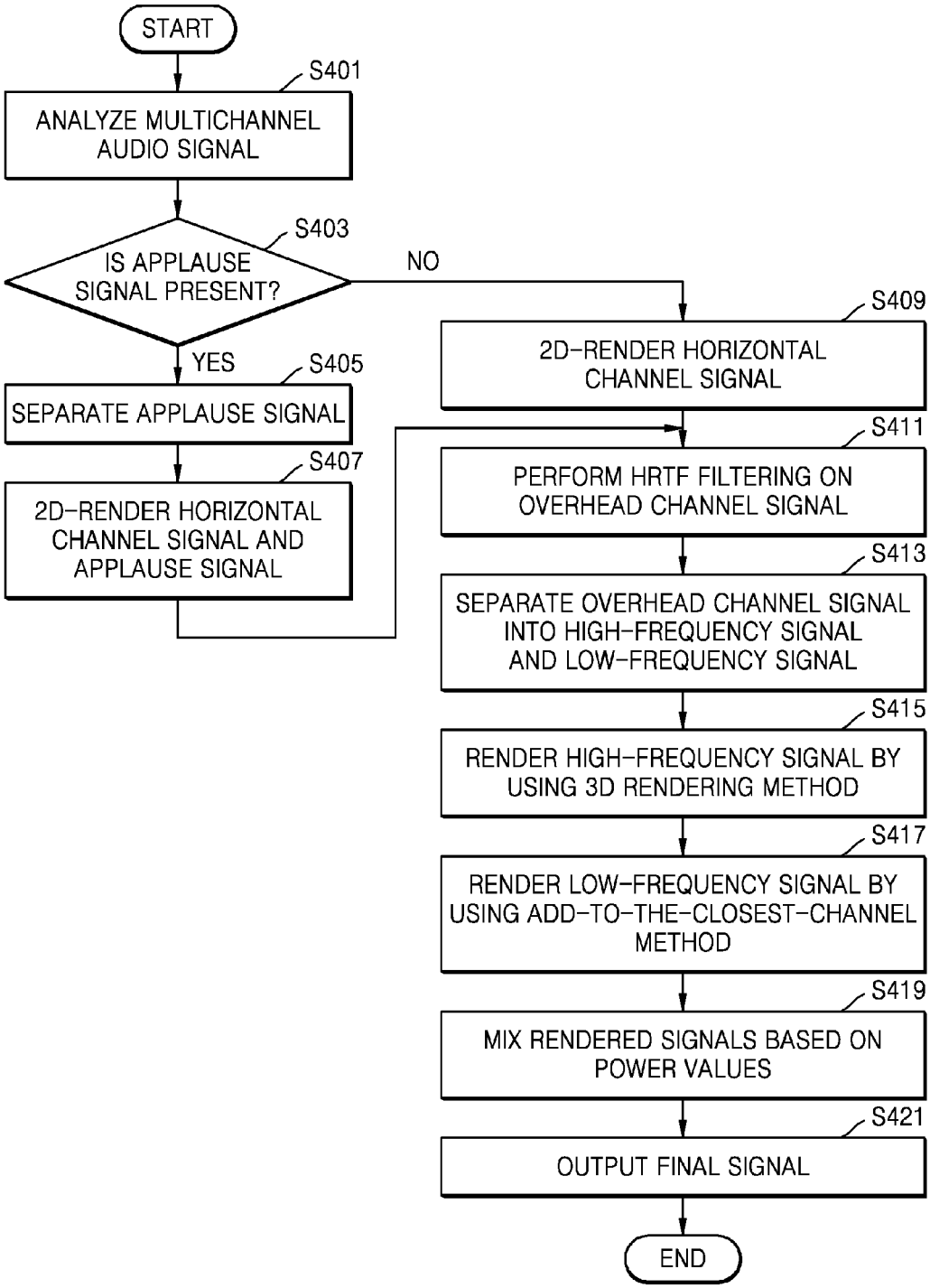
FIG. 4 is a flowchart of a 3D sound reproducing method for an audio signal including an applause signal, according to an exemplary embodiment.

FIG. 4 is a flowchart of a 3D sound reproducing method for an audio signal including an applause signal, according to an exemplary embodiment.

Referring to FIG. 4, in operation S401, the 3D sound reproducing apparatus 200 may analyze a multichannel audio signal with respect to each predetermined section so as to determine whether an applause signal is included in the multichannel audio signal.

In operation S403, the 3D sound reproducing apparatus 200 may determine whether the applause signal is included in the input multichannel audio signal, with respect to each predetermined section, for example, one frame. The 3D sound reproducing apparatus 200 may determine whether the applause signal is included in the input multichannel audio signal, with respect to each predetermined section, by analyzing flag information or the multichannel audio signal of the predetermined section to be determined. Since the 3D sound reproducing apparatus 200 processes the applause signal separately from the overhead signal or the horizontal channel signal, it is possible to reduce tone distortion when the applause signal is mixed.

In operation S405, when it is determined that the applause signal is included in the input multichannel audio signal, the 3D sound reproducing apparatus 200 may separate the applause signal. In operation S407, the 3D sound reproducing apparatus 200 may 2D-render the applause signal and the horizontal channel signal.

The horizontal channel signal may be 2D rendered according to a downmix equation or a VBAP method.

The applause signal may be rendered to the closest channel when the channel including the elevation sound is projected on the horizontal plane according to the add-to-the-closest-channel panning method, or may be rendered according to the 2D rendering method and be then mixed according to the energy boost method.

In a case where the applause signal is mixed after rendering according to the 2D or 3D rendering method, a whitening phenomenon may occur due to an increase in the number of transient components in the mixed signal, or a sound image may narrow due to an increase in a cross-correlation between channels. Therefore, in order to prevent the occurrence of the whitening phenomenon or the narrowing of the sound image, the 3D sound reproducing apparatus 200 may render and mix the applause signal according to the add-to-the-closest-channel panning method or the energy boost method, which is used to 3D-render the low-frequency signal.

The energy boost method is a mixing method of, when audio signals of channels are mixed to a single channel, increasing the energy of the horizontal channel signal so as to prevent the tone from being whitened due to the change of a transient period. The energy boost method relates to a method of mixing the rendered applause signal.

The method of mixing the applause signal according to the energy boost method may be performed based on Equation 1 below.

$$y_{out}[l,k] = \frac{\sqrt{\sum_{\forall in} (w_{in,out} x_{in}[l,k])^2}}{[x_{in=out}[l,k]]} \quad \text{[Equation 1]}$$

$x_{in=out}[l,k]$ (Processing in Frequency Domain)

$w_{in,\ out}$ is a downmixing gain. The respective channels of the multichannel audio signals are rendered to a channel to be reproduced. When the applause signal is mixed, the downmixing gain may be applied to the applause signal with respect to each channel. The downmixing gain may be previously determined as a predetermined value according to the channel to which the respective channels are rendered. $x_{in=out}[l,k]$ represents an applause signal rendered corresponding to an output layout and means any applause signal. l is a value for identifying a predetermined section of a sound signal, and k is a frequency. $x_{in=out}[l,k]/|I x_{in=out}[l,k]|$ is a phase value of an input applause signal, and values inside the root of Equation 1 may be power of applause signals corresponding to the same output channel, that is, the sum of energy values.

Referring to Equation 1, the gain of each channel to be reproduced may be modified as much as the power value of the values in which the downmixing gain is applied to a plurality of applause signals rendered to one channel of the output layout. Therefore, the amplitude of the applause signal may be increased by the sum of the energy values, and the whitening phenomenon caused by a phase difference may be prevented.

In operation S409, when it is determined that the applause signal is not included in the input multichannel audio signal, the 3D sound reproducing apparatus 200 may 2D-render the horizontal channel signal.

In operation S411, the 3D sound reproducing apparatus 200 may filter the overhead channel signal by using an HRTF filter so as to provide the 3D sound signal. When the overhead channel signal is a frequency-domain signal or a filter bank sample, HRTF filtering may be performed by simple multiplication because the HRTF filter is a filter for providing only a relative weighting of a spectrum.

In operation S413, the 3D sound reproducing apparatus 200 may separate the overhead channel signal into a high-frequency signal and a low-frequency signal. For example, the 3D sound reproducing apparatus 200 may separate the sound signal into a low-frequency signal when the sound signal has a frequency of 1 kHz or less. Since the diffraction of the low frequency component is strong in terms of acoustic characteristics, the low frequency component may be rendered by using the add-to-the-closest-channel panning method.

In operation S415, the 3D sound reproducing apparatus 200 may render the high-frequency signal by using the 3D rendering method. The 3D rendering method may include a multichannel panning method. The multichannel panning may mean that the channel signals of the multichannel audio signal are distributed to channels to be reproduced. At this time, the channel signals, to which panning coefficients are applied, may be distributed to the channels to be reproduced. In the case of the high-frequency signal, signals may be distributed to surround channels so as to provide a characteristic that an interaural level difference (ILD) is reduced as the sense of elevation increases. In addition, a direction of the sound signal may be located by the number of channels panned with a front channel.

In operation S417, the 3D sound reproducing apparatus 200 may render the low-frequency signal by using the add-to-the-closest-channel panning method. If many signals, that is, a plurality of channel signals of the multichannel audio signal, are mixed with one channel, sound quality may degrade because the sound quality is offset or amplified by different phases. According to the add-to-the-closest-channel panning method, the 3D sound reproducing apparatus 200 may map the channels to the closest channel when the channels are projected on the channel horizontal planes so as to prevent the occurrence of the degradation in sound quality, as shown in Table 1 below.

TABLE 1

| Input Channel (22.2) | Output Channel (5.1) |
|---|---|
| Top Front Left (TFL) | Front Left (FL) |
| Top Front Right (TFR) | Front Right (FR) |
| Top Surr Left (TSL) | Surround Left (SL) |
| Top Surr Right (TSR) | Surround Right (SR) |
| Top Back Left (TBL) | Surround Left (SL) |
| Top Back Right (TBR) | Surround Right (SR) |
| Top Front Center (TFC) | Front Center (FC) |
| Top Back Center (TBC) | Surrounds (SL & SR) |
| Voice of God (VOG) | Front & Surr (FL, FR, SL, SR) |

Referring to Table 1, channels, such as TBC and VOG, in which a plurality of close channels exist among the overhead channels may be distributed to a 5.1 channel by a panning coefficient for sound image location.

The mapping relationship shown in Table 1 is merely exemplary and is not limited to the above example. The channels may be differently mapped.

When the multichannel audio signal is a frequency signal or a filter bank signal, a bin or a band corresponding to a low frequency may be rendered according to the add-to-the-closest-channel panning method, and a bin or a band corresponding to a high frequency may be rendered according to the multichannel panning method. The bin or the band may refer to a signal section based on a predetermined unit in a frequency domain.

In operation S419, the 3D sound reproducing apparatus 100 may render the signals rendered to the respective channels based on power values. At this time, the 3D sound reproducing apparatus 100 may render the signals in a frequency domain. The method of mixing the signals rendered to the respective channels based on the power values will be described in more detail with reference to FIGS. 6 and 7.

In operation S421, the 3D sound reproducing apparatus 100 may output a mixed signal as a final signal.

Figure 5:
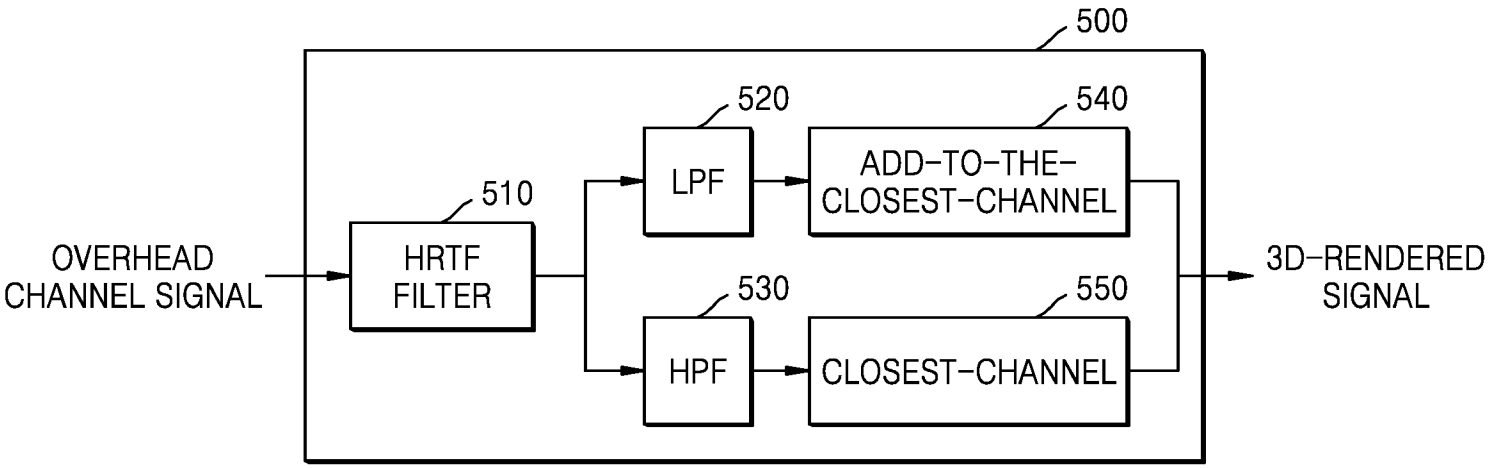
FIG. 5 is a block diagram of a 3D renderer according to an exemplary embodiment.

FIG. 5 is a block diagram of a 3D renderer 500 according to an exemplary embodiment. The 3D renderer 500 of FIG. 5 corresponds to the 3D renderer 221 of FIG. 2, and thus, redundant descriptions thereof are omitted.

Referring to FIG. 5, the 3D renderer 500 may include an HRTF filter 510, a low-pass filter (LPF) 520, a high-pass filter (HPF) 530, an add-to-the-closest-channel 540, and a multichannel panning 550.

The HRTF filter 510 may perform HRTF filtering on the overhead channel signal among the multichannel audio signals.

The LPF 520 may separate a low frequency component from the HRTF-filtered overhead channel.

The HPF 530 may separate a high frequency component from the HRTF-filtered overhead channel.

The add-to-the-closest-channel 540 may be rendered to the closest channel when the low frequency components of the overhead channel signals are projected on the channel horizontal planes.

The multichannel panning 550 may render the high frequency components of the overhead channel signals according to the multichannel panning method.

Figure 6:
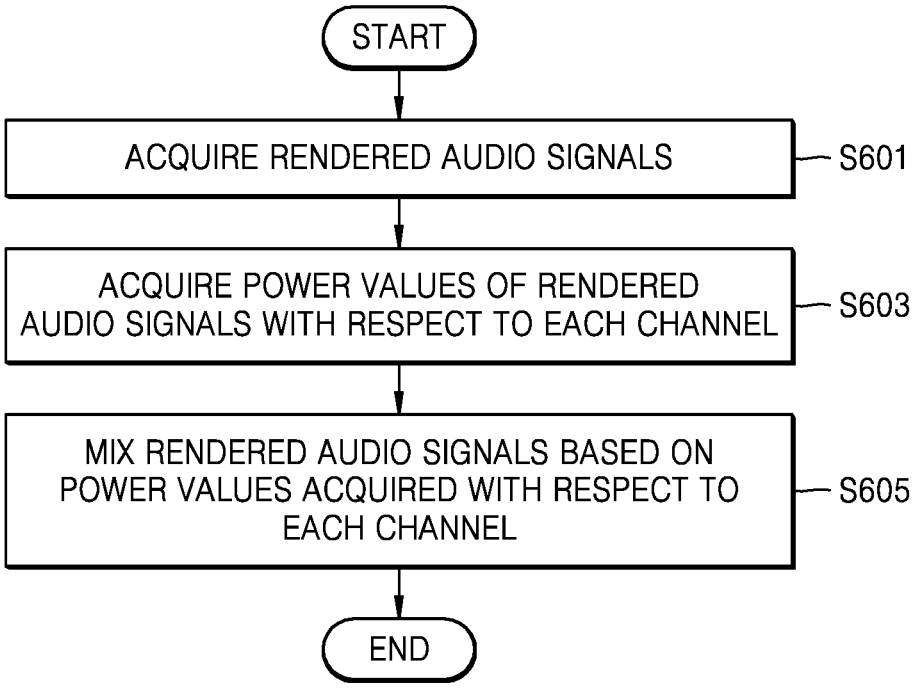
FIG. 6 is a flowchart of a method of mixing rendered audio signals, according to an exemplary embodiment.

FIG. 6 is a flowchart of a method of mixing rendered audio signals, according to an exemplary embodiment. Operations S601 to S605 of FIG. 6 correspond to operation S419 of FIG. 4, and thus, redundant descriptions thereof are omitted.

Referring to FIG. 6, in operation S601, the 3D sound reproducing apparatus 100 may acquire rendered audio signals.

In operation S603, the 3D sound reproducing apparatus 100 may acquire power values of rendered audio signals with respect to each channel. In operation S605, the 3D sound reproducing apparatus 100 may mix the rendered audio signals based on the acquired power values with respect to each channel and generate a final signal.

Figure 7:
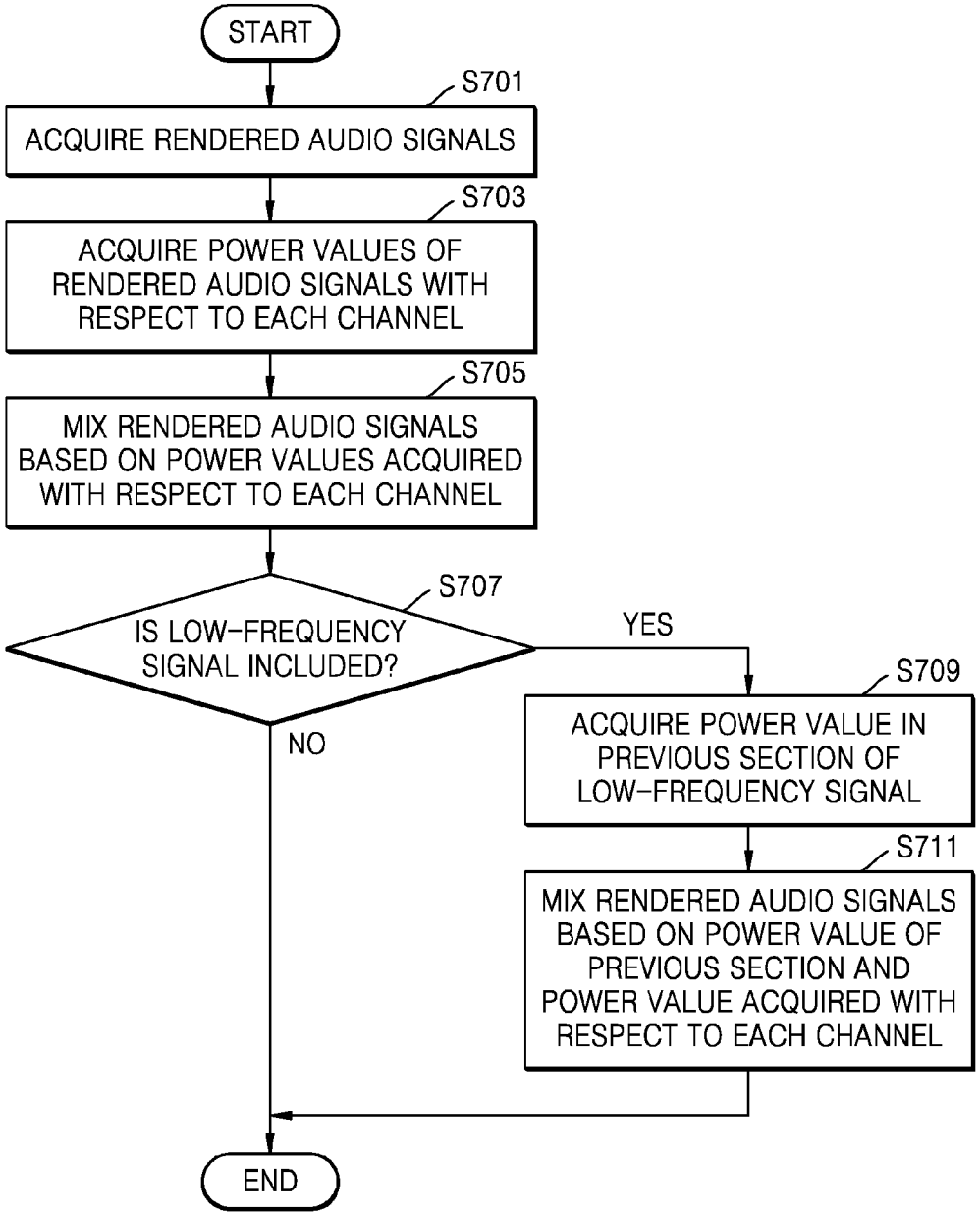
FIG. 7 is a flowchart of a method of mixing rendered audio signals according to frequency, according to an exemplary embodiment.

FIG. 7 is a flowchart of a method of mixing rendered audio signals according to frequency, according to an exemplary embodiment. Since operations S701 and S703 of FIG. 7 correspond to operations S601 and S603 of FIG. 6, respectively, redundant descriptions thereof are omitted.

Referring to FIG. 7, in operation S701, the 3D sound reproducing apparatus 100 may acquire rendered audio signals.

In operation S703, the 3D sound reproducing apparatus 100 may acquire power values of rendered audio signals with respect to each channel according to a power preserving module. In operation S705, the 3D sound reproducing apparatus 100 may mix the rendered audio signals based on the acquired power values. The power values of the rendered signals with respect to each channel may be acquired by obtaining the sum of the squares of the rendered signals with respect to each channel.

$$y_{out}[l,k] = \frac{\sqrt{\sum_{\forall in} (x_{in,out}[l,k])^2}}{[x_{out}[l,k]]} x_{out}[l,k] \text{ where } \quad \text{[Equation 2]}$$

$$x_{out}[l,k] = \sum_{\forall in} x_{in,out}[l,k] \text{ (Processing in Frequency Domain)}$$

$x_{in,\,out}$ is audio signals rendered to any channel. $x_{out}$ is a total sum of the signals rendered to any channel. l is a current section of the multichannel audio signal. k is a frequency. $y_{out}$ is a signal mixed according to the power preserving module.

According to the power preserving module, mixing may be performed such that the power of the signal finally mixed based on the power values of the signals rendered to the respective channels is preserved at the power prior to mixing. Therefore, according to the power preserving module, it is possible to prevent the sound signal from being distorted by constructive interference or destructive interference when the mixed signal is added to the rendered signals.

Referring to Equation 2, the 3D sound reproducing apparatus 100 may mix the rendered signals by applying the power values of the signals rendered to the respective channels to a phase of the total sum of the signals rendered to the respective channels.

When the signal acquired in operation S701 is a time domain, the acquired signal may be converted into a time-domain signal and be then mixed according to Equation 2. At this time, the time-domain sound signal may be converted into a frequency-domain signal according to frequency or filter bank schema.

However, when the 3D sound reproducing apparatus 100 applies the power preserving module with respect to each predetermined section, the power values of the respective signals are estimated with respect to each predetermined section. In the case of a low-frequency signal, the section capable of estimating the power values is insufficient, as compared to a wavelength. Therefore, the power values estimated with respect to each predetermined section may change, and a discontinuous part may occur in an interface between the sections to which the power preserving module is applied. On the other hand, in the case of a high-frequency signal, the section capable of estimating the power values is sufficient, as compared to a wavelength. Therefore, it is less likely that a discontinuous part will occur in an interface between the sections. That is, one-pole smoothing, which is to be described below, may be applied according to whether the section capable of estimating the power values is sufficient, as compared to the wavelength.

In operation S707, the 3D sound reproducing apparatus 100 may determine whether a part corresponding to the low-frequency signal exists in the signal mixed in operation S705. In operations S709 to S711, when it is determined that the part corresponding to the low-frequency signal exists in the mixed signal, the 3D sound reproducing apparatus 100 may remove the discontinuous part occurring in the interface between the sections, to which the power preserving module is applied, by using the one-pole smoothing of Equation 3 below.

$$y_{out}[l,k] = \sqrt{\frac{P_{in}[l,k]}{P_{out}[l,k]}}\, x_{out}[l,k] \text{ (Processing in Frequency Domain)} \quad \text{[Equation 3]}$$

where $x_{out}[l,k]=\Sigma_{vin}x_{in,out}[l,k]$, $P_{out}[l,k]=(1-\gamma)P_{out}[l-1,k]+\gamma|x_{out[l,k]}|^2$, $P_{in}[l,k]=(1-\gamma)P_{in}[l-1,k]+\gamma\Sigma_{vin}|x_{in,out}[l,k]|^2$ $P_{out}$ may be acquired based on $P_{out}$ of the previous section and the total sum of the power values of the mixed signals of the current section.

$P_{in}$ may be acquired based on the $P_{in}$ of the previous section and the total sum of the power values of the rendered signals of the current section.

The power value of the previous section may be applied to Equation 3 according to $\gamma$ that is applicable to $P_{out}$ or $P_{in}$ of the previous section. $\gamma$ may be determined to have a value smaller value as the wavelength of the low-frequency signal is longer or the frequency of the low-frequency signal is lower.

In order to remove the discontinuous part, the 3D sound reproducing apparatus 100 according to the exemplary embodiment may adjust the gain of the mixed signal based on the power value of the signals rendered in the previous section or the signal obtained by adding the rendered signals.

In addition, in a similar manner to Equation 3, the discontinuous part may be removed by performing processing of Equation 4 such that the gain of the output signal is acquired based on the gain of the output signal of the previous section.

$$y_{out}[l,k] = \frac{G_{in}[l,k]}{G_{out}[l,k]}\, x_{out}[l,k] \text{ (Processing in Frequency Domain)} \quad \text{[Equation 4]}$$

where $x_{out}[l,k]=\Sigma_{vin}x_{in,out}[l,k]$, $G_{out}[l,k]=(1-\gamma)G_{out}[l-1,k]+\gamma|x_{out}[l,k]|$, $G_{in}[l,k]=(1-\gamma)G_{in}[l-1,k]+\gamma\Sigma_{vin}|x_{in,out}[l,k]|$ In order to remove the discontinuous part, the 3D sound reproducing apparatus 100 according to the exemplary embodiment may adjust the gain of the mixed signal based on the gain applied to the signals rendered in the previous section or the signal obtained by adding the rendered signals.

Figure 8:
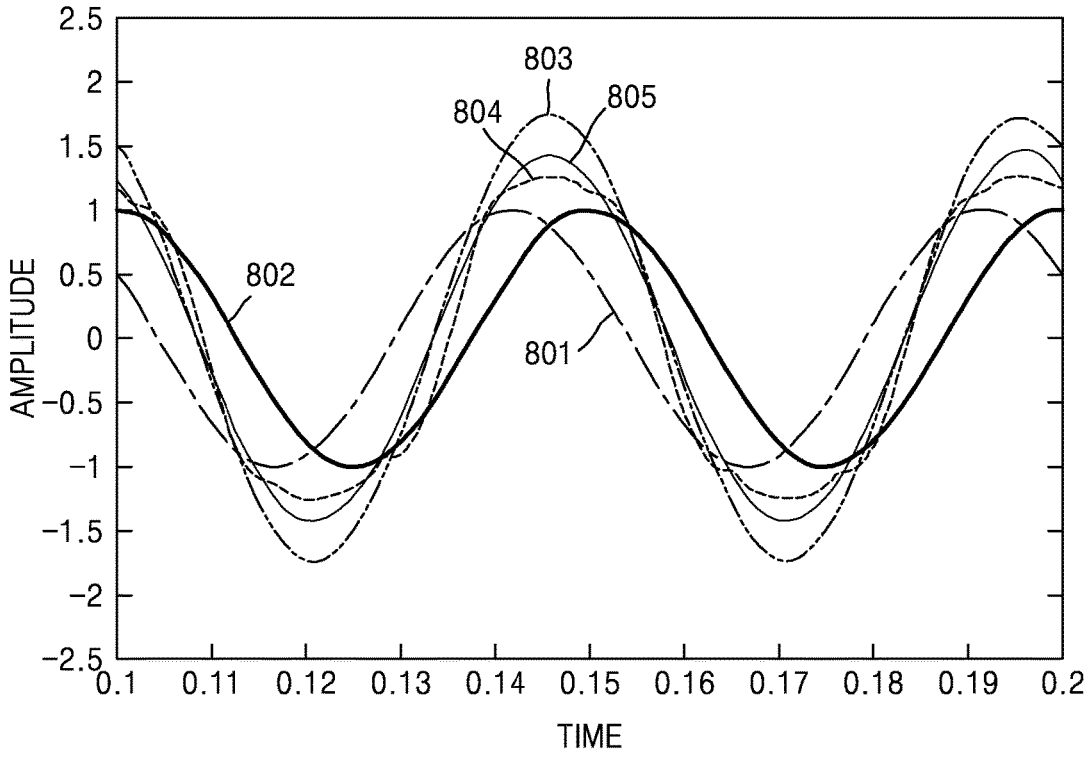
FIG. 8 is a graph of an example of mixing rendered audio signals according to frequency, according to an exemplary embodiment.

FIG. 8 is a graph of an example of mixing rendered audio signals according to frequency, according to an exemplary embodiment.

Referring to FIG. 8, in a signal 803, in which rendered audio signals 801 and 802 are added during a mixing process, the rendered audio signals 801 and 802 may sound loud as the amplitude of the signal 803 is amplified due to the phase difference between the rendered audio signals 801 and 802.

Therefore, by using the power preserving module, the 3D sound reproducing apparatus 100 according to the exemplary embodiment may determine the gain of the signal 803 based on the power values of the rendered audio signals 801 and 802.

A signal 804, which is a mixed signal according to the power preserving module, is adjusted to have a similar amplitude to those of the rendered audio signals 801 and 802, but a discontinuous part may be included in each section when the power preserving module is used with respect to each predetermined section.

Therefore, the 3D sound reproducing apparatus 100 according to the exemplary embodiment may obtain a final signal 805 by performing a smoothing process on the mixed signal according to the one-pole smoothing method with reference to the power value of the previous section.

Figure 9:
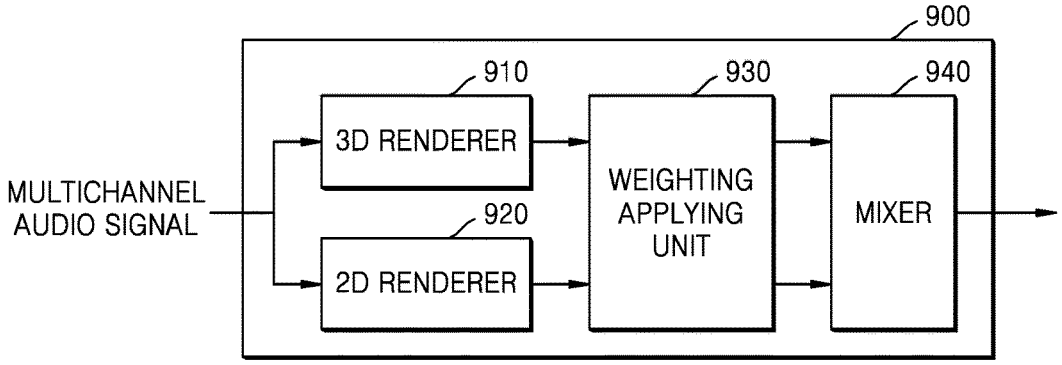
FIGS. 9 and 10 are block diagrams of 3D sound reproducing apparatuses according to exemplary embodiment.
Figure 10:
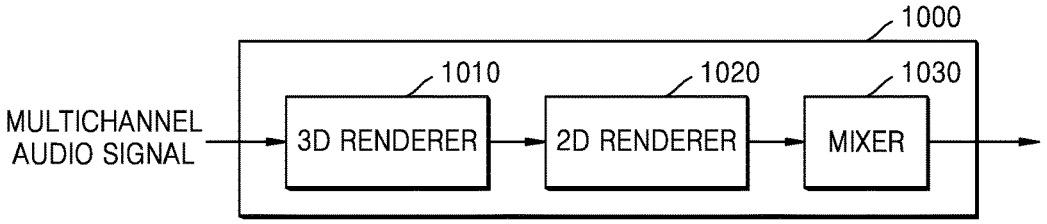

FIGS. 9 and 10 are block diagrams of 3D sound reproducing apparatuses 900 and 1000 according to exemplary embodiments.

Referring to FIG. 9, the 3D sound reproducing apparatus 900 may include a 3D renderer 910, a 2D renderer 920, a weight-applying unit 930, and a mixer 940. The 3D renderer 910, the 2D renderer 920, and the mixer 940 of FIG. 9 correspond to the 3D renderer 221, the 2D renderer 222, and the mixer 230 of FIG. 2, respectively, and thus, redundant descriptions thereof are omitted.

The 3D renderer 910 may render the overhead channel signals among the multichannel audio signals.

The 2D renderer 920 may render the horizontal channel signals among the multichannel audio signals.

The weighting applying unit 930 is an element for outputting the multichannel audio signal according to the channel layout to be reproduced, when the channel layout does not match the channel layout of the signal to be reproduced among layouts capable of being rendered by the 3D renderer 910. The layout of the channel to be reproduced may mean arrangement information of speakers to output a channel signal to be reproduced.

When the 2D renderer 920 performs rendering according to the VBAP method, it is possible to render the horizontal channel signal even in an arbitrary layout channel environment. According to the VBAP method, the 3D sound reproducing apparatus 900 may obtain the panning coefficient in an arbitrary speaker environment by just using a simple vector-based calculation and render the multichannel audio signal. Therefore, the weighting may be determined according to the degree of similarity to the layout in which an arbitrary reproduction channel layout is rendered by the 3D renderer 910. For example, when the 3D renderer 910 renders the multichannel audio signal in a 5.1 channel reproduction environment, the weighting may be determined according to how much the arbitrary layout channel environment to be rendered is different in layout from the 5.1 channel reproduction environment.

The 3D weighting applying unit 930 may apply the determined weighting to the signals rendered by the 3D renderer 910 and the 2D renderer 920.

Referring to FIG. 10, the 3D sound reproducing apparatus 1000 may include a 3D renderer 1010, a 2D renderer 1020, and a mixer 1030. The 3D renderer 1010, the 2D renderer 1020, and the mixer 1030 of FIG. 9 correspond to the 3D renderer 221, the 2D renderer 222, and the mixer 230 of FIG. 2, respectively, and thus, redundant descriptions thereof are omitted.

The 3D renderer 1010 may perform rendering by using a layout that is most similar to a layout of a channel to be rendered among renderable layouts. The 2D renderer 1020 may render the signal rendered by the 3D renderer 1010 by repanning to the channel layout of the signal to be output with respect to each channel.

For example, when the 3D renderer 1010 renders the multichannel audio signal in a 5.1 channel reproduction environment, the 2D renderer 1020 may render the 3D-rendered signal by repanning according to an arbitrary layout channel environment to be rendered by using the VBAP method.

As described above, according to the one or more of the above exemplary embodiments, the 3D sound reproducing apparatus may reproduce the elevation component of the sound signal through speakers arranged on the horizontal plane, so that a user is able to sense elevation.

According to the one or more of the above exemplary embodiments, when the multichannel audio signal is reproduced in an environment in which the number of channels is small, the 3D sound reproducing apparatus may prevent a tone from changing or prevent a sound from disappearing.

In addition, other exemplary embodiments can also be implemented through computer-readable code/instructions in/on a medium, e.g., a computer-readable medium, to control at least one processing element to implement any above-described exemplary embodiment. The medium can correspond to any medium/media permitting the storage and/or transmission of the computer-readable code.

The computer-readable code can be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as Internet transmission media. Thus, the medium may be such a defined and measurable structure including or carrying a signal or information, such as a device carrying a bitstream according to one or more exemplary embodiments. The media may also be a distributed network, so that the computer-readable code is stored/transferred and executed in a distributed fashion. Furthermore, the processing element could include a processor or a computer processor, and processing elements may be distributed and/or included in a single device.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

The invention claimed is:

1. An audio signal rendering method comprising:

receiving multichannel signals including at least one height input channel signal;

obtaining a first downmix matrix for a three-dimensional (3D) rendering over an output layout;

obtaining a second downmix matrix for a two-dimensional (2D) rendering over the output layout; and rendering the multichannel signals using at least one of the first downmix matrix and the second downmix matrix, wherein the output layout is 5.0 channel format or 5.1 channel format, wherein the first downmix matrix and the second downmix matrix use different elevation rendering for the at least one height input channel signal, and wherein the rendering comprises:

rendering the multichannel signals by using the second downmix matrix if applause bit information represents a rendering type for the multichannel signals including highly decorrelated wideband signals, and rendering the multichannel signals by using the first downmix matrix if the applause bit information represents a rendering type for a general mode.

2. The audio signal rendering method of claim 1, wherein the rendering type is indicated by a parameter included in a bitstream.

3. The audio signal rendering method of claim 2, wherein the parameter is determined based on characteristics of the multichannel signals.

4. The audio signal rendering method of claim 1, further comprising identifying a rendering type to select one of the first downmix matrix and the second downmix matrix based on a condition;

wherein the condition comprises at least one of:

a wideband sound being present in the multichannel signals;

an impulse of a section of the multichannel signals being repeated; and an inter-channel correlation being low.

5. The audio signal rendering method of claim 1, wherein the rendering comprises rendering the multichannel signals based on power values of the multichannel signals, such that the power values of the multichannel signals are preserved.

6. A non-transitory computer-readable recording medium having stored thereon a program for performing the method of claim 1.

7. The audio signal rendering method of claim 1, wherein the rendering type is identified per frame.

8. The audio signal rendering method of claim 1, wherein the rendering further comprises equalizing a tone color of a sound based on a head related transfer function (HRTF).

9. The audio signal rendering method of claim 1, the rendering comprises panning the multichannel signals by different panning methods according to a frequency range.

10. The audio signal rendering method of claim 9, wherein the different panning methods include an add-to-the-closest-channel method.

11. The audio signal rendering method of claim 1, wherein the applause bit information is included in the multichannel signals or is separately received.

12. An audio signal rendering apparatus comprising:

a receiver configured to receive multichannel signals including at least one height input channel signal;

a renderer configured to obtain a first downmix matrix for a three-dimensional (3D) rendering over an output layout and a second downmix matrix for a two-dimensional (2D) rendering over the output layout, and to render the multichannel signals using at least one of the first downmix matrix and the second downmix matrix, wherein the output layout is 5.0 channel format or 5.1 channel format, wherein the first downmix matrix and the second downmix matrix use different elevation rendering for the at least one height input channel signal, and wherein the renderer renders the multichannel signals by using the second downmix matrix if applause bit information represents a rendering type for the multichannel signals including highly decorrelated wideband signals, and renders the multichannel signals by using the first downmix matrix if the applause bit information represents a rendering type for a general mode.

13. The audio signal rendering apparatus of claim 12, rendering type is indicated by a parameter included in a bitstream.

14. The audio signal rendering apparatus of claim 13, wherein the parameter is determined based on characteristics of the multichannel signals.

15. The audio signal rendering apparatus of claim 12, wherein the renderer is configured to render the multichannel signals by the 2D rendering if the multichannel signals are for an applause sound.

16. The audio signal rendering apparatus of claim 12, wherein the renderer is further configured to identify a rendering type to select one of the first downmix matrix and the second downmix matrix based on a condition, wherein the condition comprises at least one of:

a wideband sound being present in the multichannel signals;

an impulse of a section of the multichannel signals being repeated; and an inter-channel correlation being low.

17. The audio signal rendering apparatus of claim 12, wherein the rendering type is identified per frame.

18. The audio signal rendering apparatus of claim 12, wherein the renderer is configured to equalize a tone color of a sound based on a head related transfer function (HRTF).

19. The audio signal rendering apparatus of claim 12, wherein the renderer is configured to pan the multichannel signals by different panning methods according to a frequency range.

20. The audio signal rendering apparatus of claim 19, the different panning methods include an add-to-the-closest-channel method.

21. The audio signal rendering apparatus of claim 12, wherein the applause bit information is included in the multichannel signals or is separately received.

* * * * *